United States Patent [19]

Yonezawa et al.

[11] 4,448,553

[45] May 15, 1984

[54] METHOD OF DETERMINING PRINT STARTING POSITIONS FOR AN IMPACT TYPE DOT PRINTER

[75] Inventors: Setsuo Yonezawa; Kazuaki Ikeda, both of Tokyo, Japan

[73] Assignee: Seikosha Co., Ltd., Tokyo, Japan

[21] Appl. No.: 418,534

[22] Filed: Sep. 15, 1982

[30] Foreign Application Priority Data

Sep. 16, 1981 [JP] Japan ..... 56-145885

[51] Int. Cl.[3] ..... B41J 3/12; B41J 3/08

[52] U.S. Cl. ..... 400/121; 101/93.04; 400/322

[58] Field of Search ..... 400/121, 320, 322, 328; 101/93.04, 93.09; 178/30

[56] References Cited

U.S. PATENT DOCUMENTS 3,324,240 6/1967 Kleinschmidt et al. ..... 101/93.04 X

FOREIGN PATENT DOCUMENTS 56-42666 4/1981 Japan ..... 101/93.04
56-167459 12/1981 Japan ..... 400/121
57-14055 1/1982 Japan ..... 101/93.04
57-14056 1/1982 Japan ..... 400/121
57-150584 9/1982 Japan ..... 101/93.04
57-170768 10/1982 Japan ..... 400/121

*Primary Examiner*—Paul T. Sewell
*Attorney, Agent, or Firm*—Robert E. Burns; Emmanuel J. Lobato; Bruce L. Adams

[57] ABSTRACT

An impact type dot printer is controlled to enable a printing head to start printing dot-matrix characters at aligned print starting positions. A print timing signal is generated in synchronism with rotation of the platen, the print timing signal being indicative of positions in which a print hammer strikes projections on a platen and composed of a pulse-free blank and a plurality of subsequent pulses in one cycle. The printing head is moved from a home position for pre-spacing prior to a normal printing operation. A home signal is generated when the printing head leaves the home position. The number of pulses of the print timing signal is counted until a first pulse-free blank arrives while the printing head is moving for pre-spacing. Data on a phase relationship between the print timing signal and the home signal is stored on the basis of the counted number of pulses. The number of pulses of the print timing signal is generated after the printing head has left the home position until the first pulse-free blank arrives each time the printing head is moved in spacing increments for the normal printing operation. Print starting positions are determined on the basis of the stored data and the last-mentioned number of pulses as counted.

2 Claims, 13 Drawing Figures

(1)
(2) ON OFF
(3) ON OFF
(4) ON OFF
P1
P2
A
B
C
A'
C'
H1
H1'
H1'
H2
H2'
H2''
H3
H3'
H3''
t

PRINTER MECHANISM
PRINTING HEAD
5
MOTOR
8
CLUTCH SOLENOID
21
DOT SENSOR
48
HOME SENSOR
51
PRINTER CPU
MAIN CONTROL
56
COMPARATOR
57
COUNTER
58
CLEAR START
REGISTER
59
STOP
DATA

METHOD OF DETERMINING PRINT STARTING POSITIONS FOR AN IMPACT TYPE DOT PRINTER

BACKGROUND OF THE INVENTION

The present invention relates to a method of determining print starting positions for an impact type dot printer having a printing head movable for printing in spacing increments in a direction perpendicular to the direction in which a recording medium such as printing paper is fed along.

Impact type dot printers are known which include a printing head having an electromagnetically drivable print hammer extending substantially in the direction in which a recording medium is fed along, and a platen rotatably disposed in confronting relation to the print hammer with the recording medium extending therebetween and having a plurality of axial ridges or projections on its circumference. The print hammer is selectively actuatable to hit the projections one at a time for selectively forming dots on the recording medium to print dot-matrix characters thereon.

Unlike wire printers and other types of printers, the positions of printed dots are determined by the relative positional relationship between the print hammer and the projections on the platen. Print timing pulses are generated by a dot sensor attached to a transmission gear train and energizable in synchronism with rotation of the platen. Such a print timing signal contains a pulse-free blank which is used as a reference to detect the rotational position of the projections on the platen with respect to the print hammer. More specifically, one of the projections on the platen is arranged to meet the print hammer on a first row of dot matrices when the first print timing pulse subsequent to the pulse-free blank arrives. The printing head is movable in spacing increments in synchronism with the platen at a certain relative speed through the transmission gear train, a clutch mechanism, and a carriage. A home sensor detects when the printing head leaves a home position. A print starting position is determined by using as a reference the pulse-free blank which arrives at first after the printing head has left the home position. Since there are some backlashes inherent in the transmission gear train and other intermediary mechanisms, the signal generated by the home sensor and the signal produced by the dot sensor undergo a relative phase difference, which has resulted in different print starting positions each time the printing head is moved in spacing increments, and hence in laterally shifted character positions staggered on lines. It has been customary practice to solve the foregoing problem by fabricating the parts of the dot printers with increased precision to remove unwanted backlashes as much as possible. Such an approach, however, is disadvantageous in that the dot printers become more costly, and it is almost impossible in reality to get rid of mechanical backlashes completely.

SUMMARY OF THE INVENTION

It is an object of the present invention to provide a method of determining aligned print starting positions for an impact type dot printer.

Another object of the present invention is to improve printing quality for an impact type dot printer.

According to the present invention, a printing head is moved slightly for pre-spacing prior to a normal printing operation, and the number of pulses of a print timing signal is counted after the printing head has left a home position until a first pulse-free blank of the print timing signal arrives. The relative phase relationship between the print timing signal and a home signal produced upon departure of the printing head from the home position is then stored on the basis of the number of pulses thus counted. Each time the printing head is moved in spacing increments for the normal printing operation, the number of pulses of the print timing signal is counted after the printing head has left the home position until the first pulse-free blank arrives is counted, and the stored relative phase relationship and the last-mentioned number of pulses counted are compared with each other to select a pulse from which the printing is to be started for thereby determining print starting positions. With such an arrangement, even when there is a certain phase difference between the print timing signal and the home signal each time the printing head is moved in spacing increments, the print starting positions are aligned on the first column on printed lines as long as the dot printer is switched on and thereafter the normal printing operation is continously carried out. Therefore, characters thus printed are of high quality and excellent in appearance. With the method of the present invention, no complex adjustment is necessary which would be needed to provide a desired phase relationship between the print timing signal and the home signal. Accordingly, the dot printer can be assembled and adjusted with utmost ease in a short period of time at a reduced cost.

The above and other objects, features and advantages of the present invention will become more apparent from the following description when taken in conjunction with the accompanying drawings in which a preferred embodiment of the present invention is shown by way of illustrative example.

DETAILED DESCRIPTION

Prior to the description of a method of determining print starting positions according to the present invention, the mechanical construction of an impact type dot printer to which the present invention is applicable will be described in detail.

Figure 1:
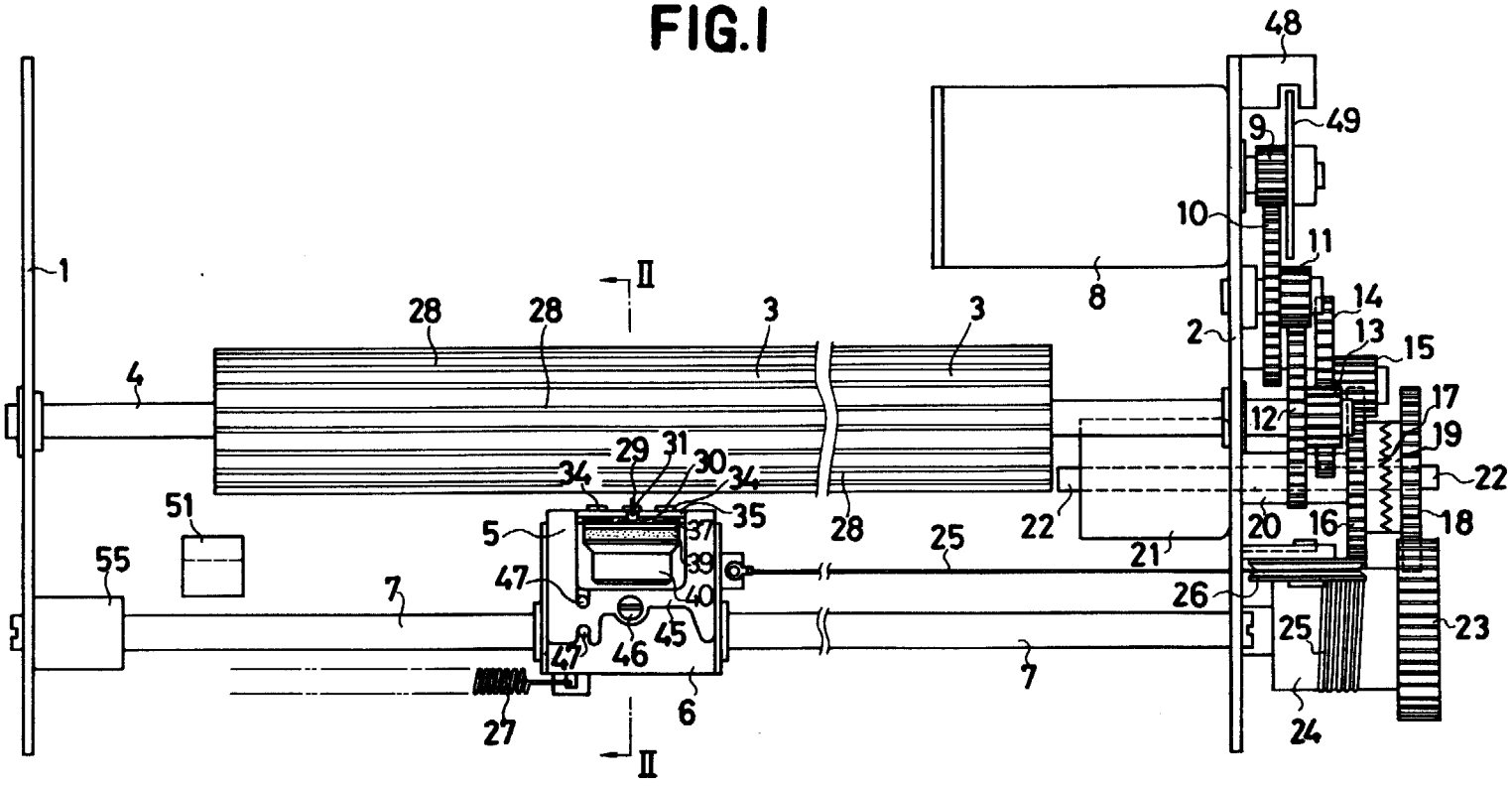
FIG. 1 is a plan view of an impact type dot printer to which a method of determining print starting positions of the present invention is applied.

In FIG. 1, the impact type dot printer has a pair of parallel side plates 1, 2 fixed to a frame (not shown) and spaced a given distance from each other, and a shaft 4 rotatably supported by the side plates 1, 2 and supporting a rotatable drum or platen 3. A printing head 5 is mounted on a carriage 6 in confronting relation to the platen 3, the carriage 6 being slidably supported on a pair of upper and lower guide shafts 7 (FIG. 2) fixed to and extending between the side plates 1, 2. The side plate 2 supports a drive motor 8 from which rotative power can be transmitted through a motor pinion 9, a gear 10 held in mesh therewith, and a gear 11 secured to the gear 10 to a gear 12, which jointly serve as a speed reducer. The gear 12 is affixed to an end of the shaft 4 which projects through the side plate 2. Therefore, the platen 3 is rotatable about its own axis in response to energization of the drive motor 8.

Rotative power from the gear 12 is also transmitted through a pinion 13 fixed thereto, a gear 14, and a pinion 15 secured thereto to a gear 16. The gear 16 has on a righthand side thereof a clutch disc 17 facing another clutch disc 19 secured to a lefthand side of a gear 18. The gear 16 is rotatably supported on a shaft 22 of a clutch solenoid 21 which extends through a sleeve 20 affixed to a righthand side of the side plate 2. The gear 16 is freely rotatably fitted over the shaft 22, but is prevented from axially moving with respect thereto. The shaft 22 is normally urged by a return spring (not shown) to be retracted to the left for bringing the clutch discs 17, 19 into mutual meshing engagement. When the clutch solenoid 21 is energized, the shaft 22 is caused to move rightward against the biasing force from the return spring to thereby disconnect the clutch discs 17, 19 from each other. The gear 18 is held in driving mesh with a gear 23 to which there is fixed a takeup drum 24 around which a cable 25 is wound with one end fastened thereto. The cable 25 extends around a pulley 26 and has a portion extending parallel to the guide shafts 7, the end of the cable 25 being attached to the carriage 6. When the cable 25 is wound around the takeup drum 24, the carriage 6 and the printing head 5 thereon are caused to move to the right along the guide shafts 7. The carriage 6 is normally urged by a return spring 27 to move back leftward. The carriage 6 can automatically return leftward to its leftmost home position under the resiliency of the return spring 27 when the clutch discs 17, 19 are disengaged from each other.

Figure 2:
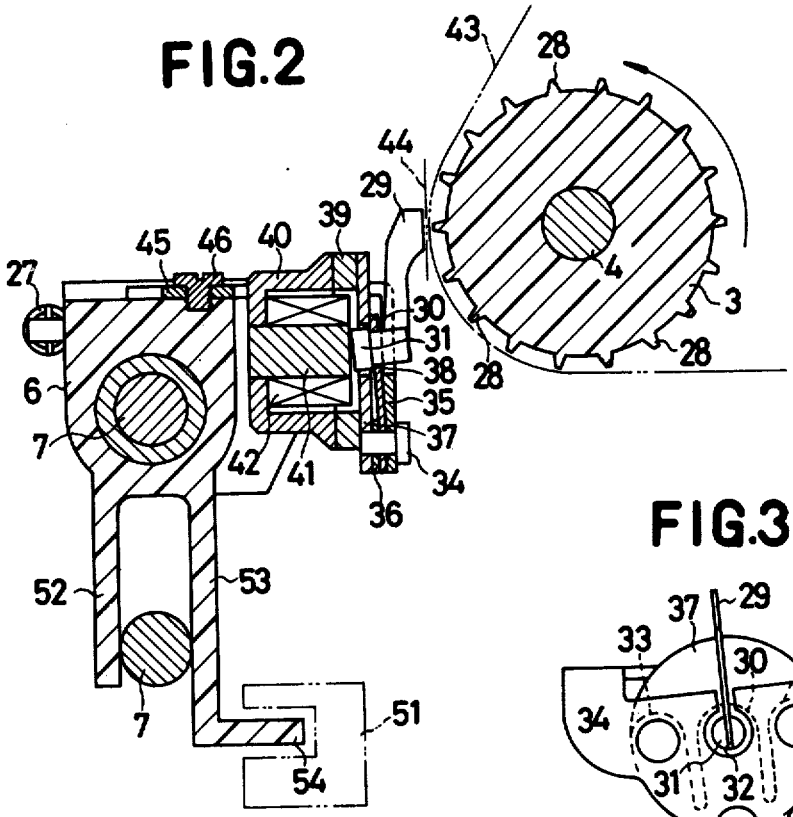
FIG. 2 is an enlarged cross-sectional view taken along line II—II of FIG. 1.
Figure 3:
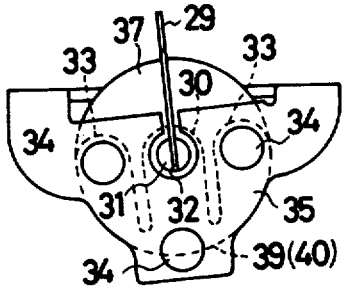
FIG. 3 is an enlarged front elevational view of a printing head of the impact type dot printer shown in FIG. 1.

As better shown in FIG. 2, the platen 3 has on its circumference a plurality of integral ridges or projections 28 extending axially of the platen 3 and spaced at equal intervals around the circumference of the platen 3. As illustrated in FIGS. 2 and 3, the printing head 5 has a plate-like print hammer 29 confronting one of the projections 28 at a time and inclined at an angle to and extending across the projection 28. The print hammer 29 has a lower end clamped in a slot 32 in a movable yoke 31 fixed to a free end of a spring plate 30. The spring plate 30 has a proximal lower end from which extends a pair of tongues 33, 33, the proximal end and the tongues 33, 33 being fastened to a support plate 35 by means of pins 34. A front yoke 37 is affixed by the pins 34 to the spring plate 30 with a spacer plate 36 therebetween. The front yoke 37 is substantially circular in shape and has a central hole 38 through which a rear end of the movable yoke 31 extends. An annular permanent magnet 39 is secured to the front yoke 37 remotely from the spring plate 30. A cylindrical cap-shaped rear yoke 40 is affixed to the permanent magnet 39 remotely from the front yoke 37. A central yoke 41 is secured centrally to the bottom of the rear yoke 40 and extends toward the front yoke 37. The movable yoke 31 is normally magnetically attracted to a front end of the central yoke 41 under the magnetic force from the permanent magnet 39. Therefore, the print hammer 29 is normally kept retracted from the projections 28 on the platen 3. A release coil 42 is wound around the central yoke 41 for cancelling out magnetic fluxes generated by the permanent magnet 39 when the release coil 42 is energized. Upon energization of the release coil 42, the movable yoke 31 is released of magnetic attraction toward the central yoke 41, and hence the spring plate 30 is no longer urged rearward, whereupon the print hammer 29 is caused by the resilient force of the spring plate 31 to move forward into striking engagement with one of the projections 28 on the platen 3. Since a recording medium 43 and an ink ribbon 44 extend between the projection 28 and the print hammer 29 as illustrated in FIG. 2, a dot is formed on the recording medium 43 where the print hammer 29 strikes the projection 28. The support plate 35 has an integral bent lateral portion 45 fastened by a screw 46 to the carriage 6.

Figure 4:
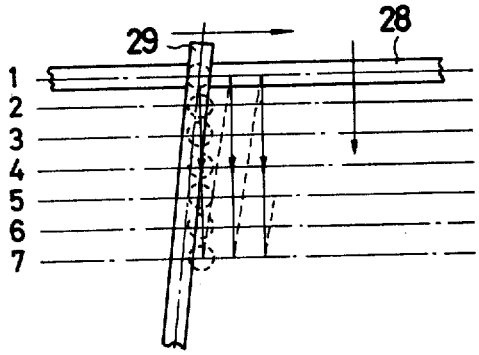
FIG. 4 is an enlarged elevational view of a projection on a platen and a print hammer of the printing head as they are positioned relatively to each other.
Figure 5:
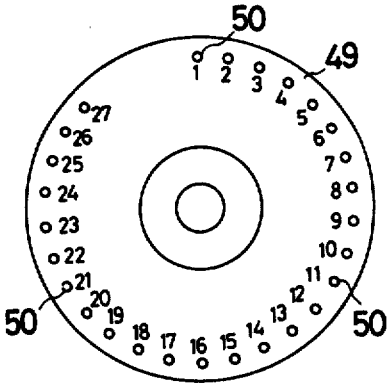
FIG. 5 is an enlarged front elevational view of a detection disc.
Figure 10:
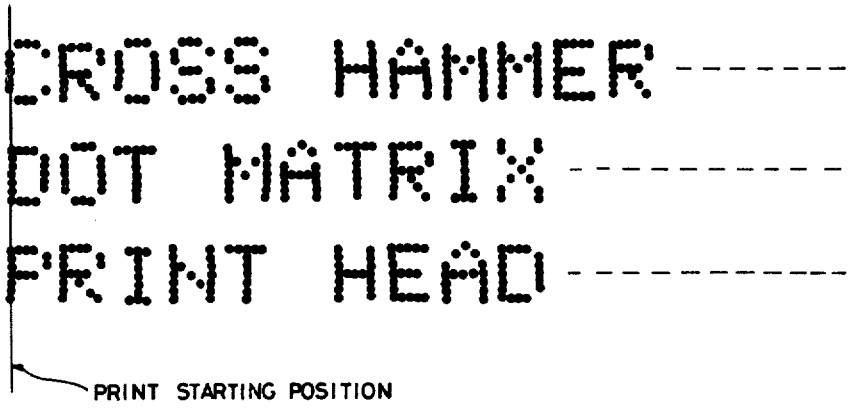
FIG. 10 is an enlarged front elevational view of letters as printed in alignment on lines according to the method of the present invention.

The projections 28 and the print hammer 29 will meet at successively shifted positions in a manner described below. The projections 28 are successively brought into confronting relation to the print hammer 29 in response to rotation of the platen 3. As the projections 28 are thus shifted, they meet the print hammer 29 at successive crossing positions in the direction of vertical columns of dot matrices to be printed as shown in FIG. 4. At the same time, the printing head 5 on the carriage 6 moves laterally in spacing increments to enable the print hammer 29 to meet the projections 28 at successive crossing positions in the direction of horizontal rows of dot matrices to be printed. With the print hammer 29 inclined with respect to the projection 28, the projection 28 and the print hammer 29 will cross each other on aligned dots along a given column of a matrix even when the platen 3 rotates and the printing head 5 moves laterally at the same time. On rightward movement of the print hammer 29, the release coil 42 (FIG. 2) is energized for selected intervals to force the print hammer 29 to selectively strike the projection 28 for forming desired dot-matrix characters on the recording medium 43 as shown in FIG. 10.

The print timing at which the print hammer 29 is to be driven can be determined by signals generated by a dot sensor 48 shown in FIG. 1. The dot sensor 48 contains a light-emitting device and a photodetector (not shown) which are disposed in confronting relation across a slot in the dot sensor 48, in which slot there is inserted an outer peripheral edge of a detection disc 49 secured to the motor pinion 9 for corotation. A home ensor 51 is fixed in position near the side plate 1, the ome sensor 51 also housing a light-emitting device and photodetector (not shown) which face each other across a slot (FIG. 2). The carriage 6 includes a pair of vertical legs 52, 53, the leg 53 having an integral shield plate 54 which is movable into the slot in the home sensor 51 when the carriage 6 is moved back to its home position. In FIG. 1, a bumper 55 made of elastomeric rubber is fitted over the upper guide shaft 7 at a lefthand end thereof. The bumper 55 serves to determine the home position of the printing head 5 or the carriage 6, and to absorb the shock of collision when the carriage 6 is retracted to the home position under the returning force of the return spring 27.

Figure 6:
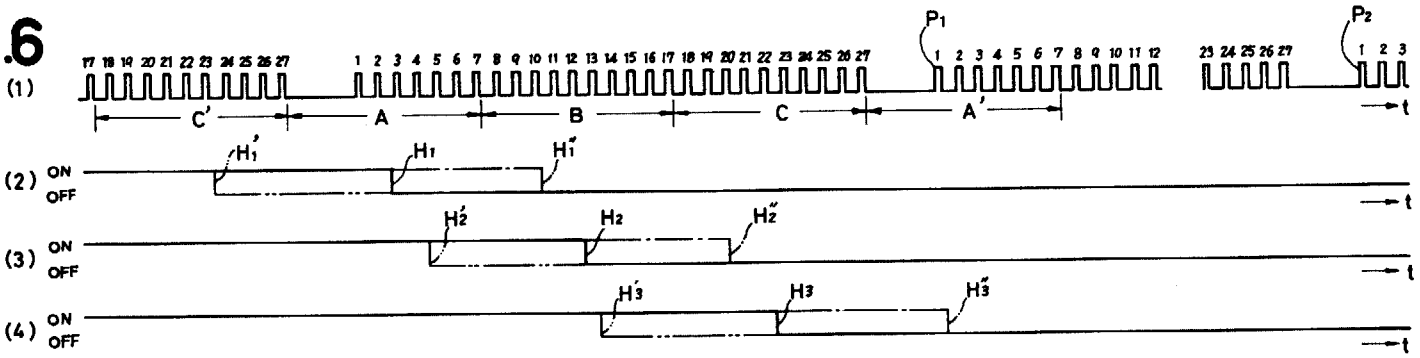
FIG. 6 is a diagram showing signal waveforms indicative of a phase relationship between a print timing signal and a home signal.

According to the present invention, the detection disc 49 has its outer peripheral edge divided into 30 equal regions, 27 out of which have apertures 50 successively defined at equal angular intervals. No such apertures are formed in the remaining 3 regions. With the detection disc 49 of such a design, the dot sensor 48 will produce a print timing signal which is composed of 27 periodic successive pulses followed by a pulse-free blank which corresponds to three pulses, as illustrated in FIG. 6(1). The home sensor 51 produces either one of the three home signals $H_1$, $H_2$, and $H_3$ which are related in phase to each other as shown in FIG. 6(2), (3) and (4) when the printing head 5 is shifted rightward from the home position. More specifically, the print timing signal in one cycle is divided into three zones A, B and C. The home signals $H_1$, $H_2$, $H_3$ have falling edges in either the zone A, the zone B, or the zone C at a timing which is affected by backlashes in the transmission gears 9 through 19. Thus, the falling edges of the home signals tend to have varied phases $H'_1$, $H''_1$ or $H'_2$, $H''_2$ or $H'_3$, $H''_3$ as shown in FIG. 6 (2), (3) and (4) each time the printing head 5 is shifted in spacing increments. Such phase differences can however be limited mechanically to a certain tolerable range, which corresponds to about $\pm 10$ pulses of the print timing signal in the illustrated embodiment. The divided zones of the print timing signal are determined on the basis of such a tolerable range. More specifically, the first zone A and the final zone C have a width selected to be substantially equal to the tolerable range with the zone A including the pulse-free blank (corresponding to three pulses). The intermediate zone B has a remaining width in the print timing signal. With the illustrated embodiment, the width of the zone B is the same as that of the zones A, C, but is variable with the number of pulses of the print timing signal or the number of pulses corresponding to the pulse-free blank.

Before the printing head 5 is shifted in spacing increments for a normal printing operation, that is, immediately after the power supply for the dot printer has been switched on, the printing head 5 is shifted in a pre-spacing increment to determine what phase relationship the home signal has with respect to the print timing signal prior to the printing operation.

Figure 7:
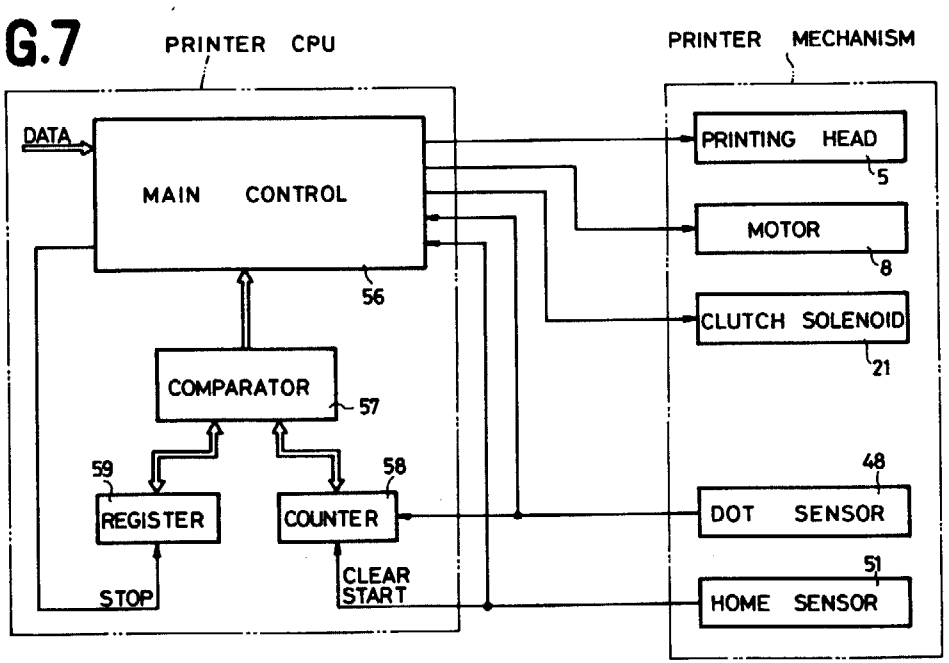
FIG. 7 is a block diagram of an electric circuit of the dot printer.

A central processing unit (CPU) shown in FIG. 7 is responsive to such determined phase relationship for determining a print start position for the printing to be effected. The central processing unit includes a main control 56, a comparator 57, a counter 58 and a register 59 which will operate in sequences as shown by the flowchart in FIGS. 8 and 9. The main control 56 is supplied with an output signal delivered from the comparator 57, the print timing signal generated by the dot sensor 48, and the home signal generated by the home sensor 49 for processing printing data fed from an external apparatus to generate drive signals for a printer mechanism having the printing head 5, the drive motor 8 and the clutch solenoid 21. The counter 58 can be cleared by the falling edge of the home signal from the home sensor 51 to start counting pulses of the print timing signal from the dot sensor 48. When the pulse-free blank of the print timing signal arrives, the main control 56 issues a stop signal to stop the counting operation in the counter 58. The counting operation in the counter 58 is repeated each time the printing head 5 is shifted rightward from the home position, and the count signal from the counter 58 and stored data in the register 59 are compared with each other by the comparator 57 to determine a print starting position.

Figure 8:
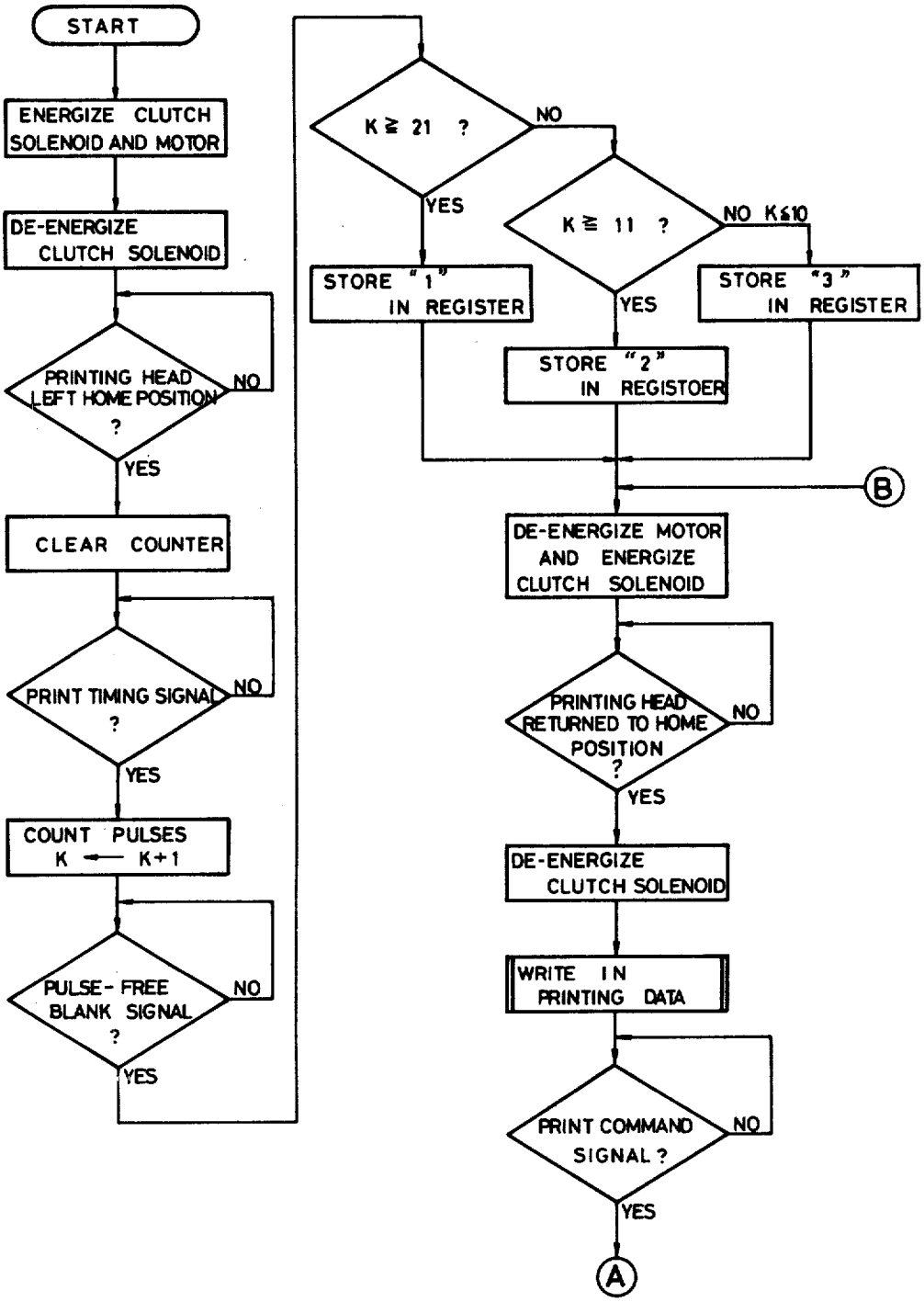
FIGS. 8 and 9 are a flowchart showing successive steps for determining print starting positions according to the present invention.
Figure 9:
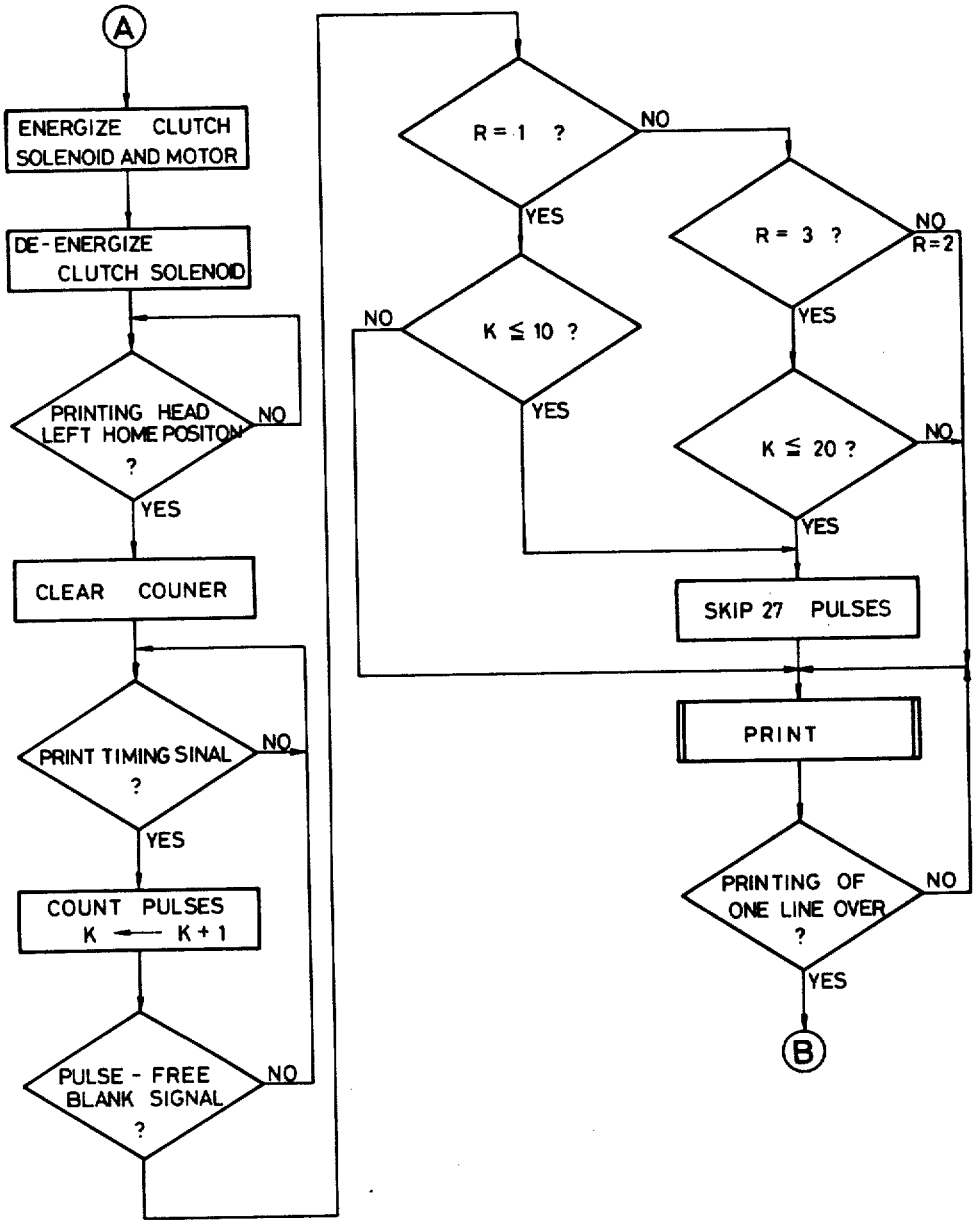

Such an operation for determining a print starting position will be described in more detail with reference to FIGS. 8 and 9. At an initial stage, the printing head 5 is in the left home position in FIG. 1. When the dot printer power supply is switched on, the clutch solenoid 21 and the drive motor 8 are energized. Energization of the clutch solenoid 21 disengages the clutch discs 17, 19 from each other. Upon energization of the motor 8, the shaft 4 and hence the platen 3 are rotated by the gears 9 through 12, and at the same time the dot sensor 48 starts issuing the print timing signal as shown in FIG. 6(1) in response to rotation of the detection disc 49. After a predetermined delay time has elapsed, that is, a period of time has elapsed which is required for the motor 8 to reach a normal rotation mode, the clutch solenoid 21 is de-energized to allow the clutch discs 17, 19 to be interconnected, for thereby enabling the gears 18, 23 to rotate the takeup drum 24. The cable 25 then starts being wound around the drum 24, whereupon the carriage 6 starts to move rightward along the guide shafts 7 for shifting the printing head 5 in a pre-spacing increment. As the shield plate 54 moves out of the home sensor 51, i.e., the printing head 5 leaves the home position, the home signal generated by the home sensor 51 falls to zero as shown in FIG. 6(2), (3) or (4). The counter 58 is then cleared to count pulses of the print timing signal from the dot sensor 48 until the pulse-free blank arrives. The count in the counter 58 indicates in which zone A, B or C the home signal has had its falling edge. More specifically, when the home signal has its falling edge in each of the zones A, B and C, the count K in the counter 58 is in the range of $27 \geqq K \geqq 21$, $20 \geqq K \geqq 11$, and $10 \geqq K \geqq 1$, respectively.

When $27 \geqq K \geqq 21$, $20 \geqq K \geqq 11$, and $10 \geqq K \geqq 1$, the register 59 stores a numerical value of "1", "2" and "3", for example, respectively. The motor 8 is then de-energized and the clutch solenoid 8 is energized. The clutch discs 17, 19 are disconnected, whereupon the carriage 6 returns to the home position under the force of the return spring 27. Then, the clutch solenoid 8 is de-energized again. The pre-spacing of the printing head 5 is thus completed. The pre-spacing increment which the printing head 5 traverses rightward is quite small.

Printing data for one line is written into a character buffer within the main control 56. When a printing command signal arrives, the following printing operation starts to be carried out as shown in FIG. 9. The motor 8 is energized and the clutch solenoid 21 is also energized to disconnect the clutch discs 17, 19. When the motor 8 rotates at a normal speed, the clutch solenoid 21 is de-energized to connect the clutch discs 17, 19 with each other. The printing head 5 now moves to the right for a spacing increment on leaving the home position, whereupon the signal generated by the home sensor 51 drops to zero. The counter 58 is cleared to eliminate the previous count therein, and starts counting pulses of the print timing signal produced by the dot sensor 48 until the pulse-free blank of the print timing signal arrives.

As described above, the print timing signal and the home signal are subjected to a phase difference of about ±10 pulses due to backlashes in the gears 9 through 19 and 23. For example, if the home signal $H_1$ has its falling or negative-going edge in the zone A of the print timing signal upon pre-spacing, at which time the register 59 stores "1", the home signal upon spacing for normal printing operation may have its falling edge in the zone A, or a prior zone C', or a subsequent zone B, as shown in FIG. 6(2). Such a phase difference can be detected by the comparator 57 on the basis of the current count K in the counter 58. More specifically, if the current count K is 10 or smaller when the stored data R in the register 59 is "1", then the home signal has its falling edge in the zone C', and the main control 56 skips 27 pulses after the first pulse-free blank and starts printing operation from the first pulse P1 on subsequent to the second pulse-free blank. If the current count K is 11 or larger when the stored data R is "1", then the home signal has its falling edge in the zone A or B, and at this time, the main control 56 controls to start printing operation from the first pulse P1 on after the first pulse-free blank, which is the same as the second pulse-free blank as described above. After the printing of one line has been completed, the printing head 5 returns to the home position to repeat successive printing operations.

If the home signal has its falling edge in the zone C of the print timing signal and "3" is stored in the register 59 upon pre-spacing, the home signal may have its falling edge in the zone C or a prior zone B or a subsequent zone A' upon movement in a spacing increment for a printing operation, as shown in FIG. 6(4). If the current count K in the counter 58 is 20 or smaller when the stored data R in the register 59 is "3", then the home signal falls to zero in the zone B or C. The main control 56 now controls to skip 27 pulses of the print timing signal after the first pulse-free blank and start printing operation from the first pulse P2 on after the second pulse-free blank. If the current count K is 21 or greater, then the falling edge of the home signal lies in the zone A', whereupon the printing starts from the first pulse P2 after the first pulse-free blank. The printing head 5 returns to the home position after the printing operation is over, and then repeats following printing operations.

If the home signal has its falling edge in the zone B of the print timing signal and "2" is stored in the register 59 upon pre-spacing, the home signal may have its falling edge in the zone B or a prior zone A or a subsequent zone C upon movement in a spacing increment for a printing operation, as shown in FIG. 6(3). When the stored data R in the register 59 is "3", the printing operation is controlled by the main control 56 to start from the first pulse P1 on after the first pulse-free blank irrespective of where the home signal falls to zero. Then, the printing head 5 moves back to the home position upon completion of the printing operation for one line, and successive printing operations are repeated.

The dot sensor 48 and the home sensor 51 may comprise magnetic sensors. Although not shown, the printing head 5 and the mechanism for moving the same in spacing increments and returning the carriage 6 may be of different designs as desired. The print timing signal may be divided into two zones, and the printing head may be shifted for periodical pre-spacing operations under command signals.

Figure 11:
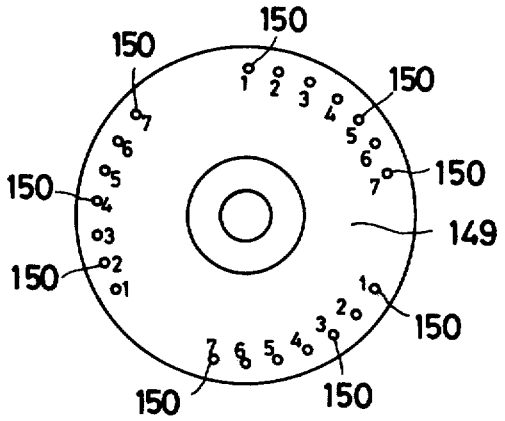
FIG. 11 is an enlarged front elevational view of a conventional detection disc.
Figure 12:
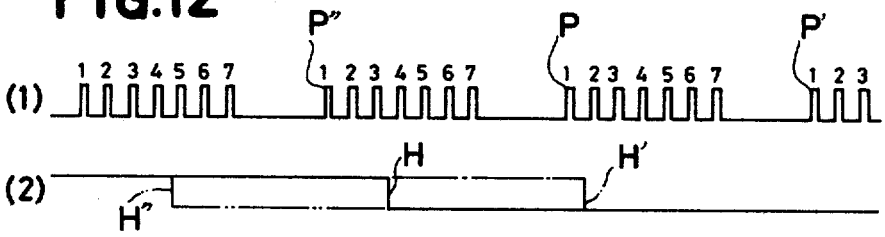
FIG. 12 is a diagram showing signal waveforms indicative of the phase relationship between a printing timing signal and a home signal.
Figure 13:
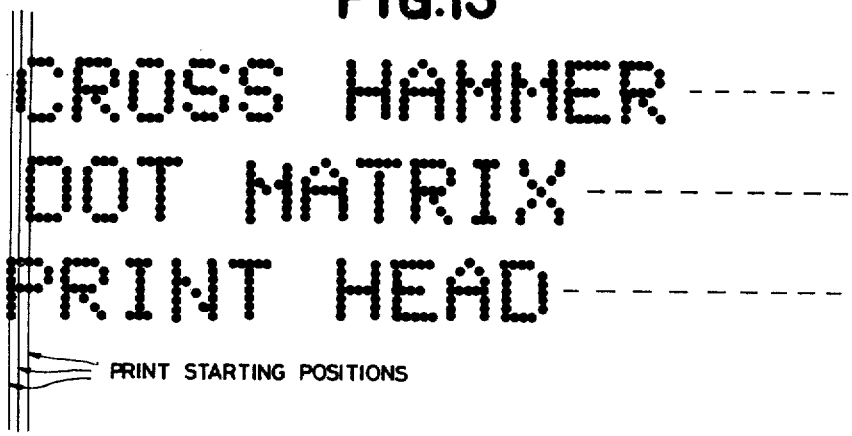
FIG. 13 is an enlarged front elevational view of letters as printed out of alignment on lines according to a conventional method.

A conventional arrangement for determining print starting positions will be described with reference to FIGS. 11 through 13 for comparison with the method according to the present invention. As shown in FIG. 11, a prior detection disc 149 has a plurality of groups (three as shown) of apertures 150. The apertures 150 in each group are angularly spaced at an equal angular interval or pitch of 360°/30=30°. The number of the apertures 150 corresponds to the number of rows of the dot matrix. As an example, where characters are represented by a dot matrix having five columns and seven rows, the number of apertures in each group is seven with the aperture groups being spaced an interval corresponding to three such apertures. With the detection disc 149 utilized, the dot sensor as shown in FIG. 1 periodically produces a print timing signal composed of seven successive pulses in one cycle as shown in FIG. 12(1). The print hammer is selectively driven by the print timing signal. When the projections on the platen are displaced to the positions of the first, second, . . . , seventh rows, the dot sensor produces first, second, . . . , seventh pulses, respectively. The home sensor generates a home signal H having a timing as shown in FIG. 12(2) with respect to the print timing signal from the dot sensor. The phase relationship between the print timing signal and the home signal is adjusted at the time of assembly of the dot printer. Thus, the home signal H has a falling edge lying substantially centrally of the print timing signal, for example, between the third and fourth pulses thereof. Printing operation starts to be effected from the first pulse P on subsequent to the first pulse-free blank of the print timing signal after the home signal H has fallen to zero, that is, the printing head has left the home position. The phase difference between the print timing signal and the home signal due to backlashes in a power transmission system such as the gears 9 through 23 shown in FIG. 1 sometimes reaches an interval which corresponds to about ±10 pulses of the print timing signal. If the falling edge of the home signal H is shifted to a position of H' as shown in FIG. 12(2), then the printing operation starts from a pulse P' and continues thereafter, and if the falling edge of the home signal H is shifted to a position H'', then the printing operation is initiated from a pulse P'' and continues thereafter. Such a phase difference results in different print starting positions on the printed lines, which may be one dot ahead or behind the reference print starting position designed or adjusted in advance. Therefore, the printed characters have been quite unsightly.

Although a certain preferred embodiment has been shown and described in detail, it should be understood that many changes and modifications may be made therein without departing from the scope of the appended claims.

What is claimed is:

1. A method of determining print starting positions for an impact type dot printer including a rotatable platen having a plurality of axial projections and a printing head movable from a home position in spacing increments along the platen and having a print hammer actuatable to hit the projections one at a time to print dot-matrix characters on a recording medium between the platen and the print hammer, said method comprising the steps of:

generating a print timing signal in synchronism with rotation of the platen, said print timing signal being indicative of positions in which the print hammer strikes the projections and being composed of a pulse-free blank and a plurality of subsequent pulses defining one cycle;

moving the printing head from the home position for pre-spacing prior to a normal printing operation;

generating a home signal when the printing head leaves the home position;

counting the number of pulses of said print timing signal until a first pulse-free blank arrives while the printing head is moving for pre-spacing;

storing data on a phase relationship between said print timing signal and said home signal based on the counted number of pulses;

counting the number of pulses of said print timing signal generated after the printing head has left the home position until the first pulse-free blank arrives each time the printing head is moved in spacing increments for the normal printing operation; and setting print starting positions based on said stored data and said last-mentioned number of pulses as counted.

2. A method according to claim 1, wherein the printing head is automatically moved for pre-spacing immediately after the impact type dot printer has been switched on.

* * * * *